US006836986B2

(12) United States Patent
Ootsuta et al.

(10) Patent No.: US 6,836,986 B2
(45) Date of Patent: Jan. 4, 2005

(54) APPARATUS FOR DISPLAYING A FLYING OBJECT

(75) Inventors: Katsuhisa Ootsuta, Tokyo (JP); Toshio Ito, Tokyo (JP); Takeshi Ono, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 42 days.

(21) Appl. No.: 10/289,218

(22) Filed: Nov. 7, 2002

(65) Prior Publication Data

US 2003/0089008 A1 May 15, 2003

(30) Foreign Application Priority Data

Nov. 12, 2001 (JP) ..... 2001-345685

(51) Int. Cl.[7] ..... G09F 19/00
(52) U.S. Cl. ..... 40/439; 40/406; 40/409
(58) Field of Search ..... 40/406, 407, 409, 40/439

(56) References Cited

U.S. PATENT DOCUMENTS 1,824,388 A * 9/1931 Birch ..... 40/439
2,911,745 A * 11/1959 Simon ..... 40/407
3,726,025 A * 4/1973 Salem ..... 40/439
4,345,395 A * 8/1982 Grassi ..... 40/406
5,314,368 A * 5/1994 Cheng ..... 40/406
6,382,808 B1 * 5/2002 Lin ..... 40/409

FOREIGN PATENT DOCUMENTS

| | | |
|---|---|---|
| JP | 54-63980 | 5/1979 |
| JP | 60-83689 | 5/1985 |
| JP | 1-120899 U | 8/1989 |
| JP | 1-314199 | 12/1989 |
| JP | 3-16193 U | 2/1991 |
| JP | 3-168174 | 7/1991 |
| JP | 5-5499 | 1/1993 |
| JP | 2000-262772 | 9/2000 |

* cited by examiner

*Primary Examiner*—Lars A. Olson
(74) *Attorney, Agent, or Firm*—Leydig, Voit & Mayer, Ltd.

(57) ABSTRACT

In an apparatus for displaying a flying object, an air flow is created in a duct by a group of blowers. A holding line is attached to a lightweight flying object, and movement of the lightweight flying object is restricted by the holding line. By making the lightweight flying object fly in the air flow, the lightweight flying object is able to fly even in a small space.

15 Claims, 10 Drawing Sheets

APPARATUS FOR DISPLAYING A FLYING OBJECT

BACKGROUND OF THE INVENTION

1. Field of the Invention

This invention relates to an apparatus for displaying a flying object within determined space and its method.

2. Description of the Related Art

In the related art, Japanese Unexamined Patent Publication HEI 1-314199 discloses an object like a still life in appearance, which changes its movements in reacting to an ambient factor, e.g., light and sound.

FIG. 10A, FIG. 10B, and FIG. 10C illustrate the related art. A motor 5 provided in a picture frame is driven by a signal, and a sailboat and a bird are moved by a linkage mechanism.

In FIG. 10A, a base body 1 of the object which changes its movements in reacting to the ambient factor, e.g., light and sound, is illustrated. Operation units 2 move in reacting to the ambient factor of sound. In FIG. 10A, the operation units 2 have the shapes of a sailboat and a bird. A sound sensor 3 is illustrated. A picture unit 8 includes the operation units 2.

FIG. 10B illustrates a back side of the base body 1. In FIG. 10B, same numbers are used for same elements illustrated in FIG. 10A. In FIG. 10B, the motor 5, a gear 6 fixed to a power shaft of the motor 5, a rack 7 which moves in a horizontal direction in reacting to rotation of the motor 5, and magnetic materials 9 which move in reacting to movement of the rack 7 are illustrated.

FIG. 10C illustrates a side view of FIG. 10A and FIG. 10B. In FIG. 10C, same numbers are used for same elements illustrated in FIG. 10A and FIG. 10B. Magnetic materials 4 are attached to back sides of the operation units 2.

The base body 1 is structured as stated, and movements are as follows.

When the sound sensor 3 senses external sound at determined volume, the motor 5 rotates. Since the gear 6 fixed to the power shaft of the motor 5 is engaged with the rack 7, the rack 7 moves in the horizontal direction in reacting to rotation of the motor 5. Magnetic materials 9 provided in the rack 7 and the magnetic materials 4 provided on the back side of the operation units 2 attract each other. Therefore, the operation units 2 move on a surface of the picture unit 8 corresponding to the magnetic materials 9 and the magnetic materials 4 in reacting to movements of the rack 7.

As stated, the operation units 2 are formed in shapes of the sailboat and the bird on the picture unit 8. Since the operation units 2 move by a drive mechanism which operates when the sound sensor 3 senses the external sound at specific physical volume, it is possible to change scenes of the picture unit 8.

As stated, the related art discloses the object like the still life in appearance, which changes its movements in reacting to a certain signal. However, in the related art, it is impossible to obtain an idea on a display apparatus including an object which flies within limited space using an air flow created.

SUMMARY OF THE INVENTION

It is an object of this invention to make a flying object fly within determined space.

According to an aspect of this invention, an apparatus for displaying a flying object includes a space forming unit for forming determined flying space, an air flow creator for creating an air flow in the flying space formed by the space forming unit, and a flying object for flying by the air flow created by the air flow creator in the space formed by the space forming unit. The apparatus for displaying the flying object also includes a connecting unit connected to the flying object, including a holding line for restricting the flying space in which the flying object flies.

According to another aspect of this invention, a method for displaying a flying object includes forming determined flying space, creating an air flow in the flying space formed, and making a flying object fly by the air flow created in the flying space formed. The method for displaying the flying object also includes connecting a holding line to the flying object and restricting the flying object to the flying space.

Further features and applications of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Other objects features, and advantages of the invention will be apparent from the following description when taken in conjunction with the accompany drawings.

DETAILED DESCRIPTION OF THE PREFERRED EMBODIMENTS

Embodiment 1.

Figure 1:
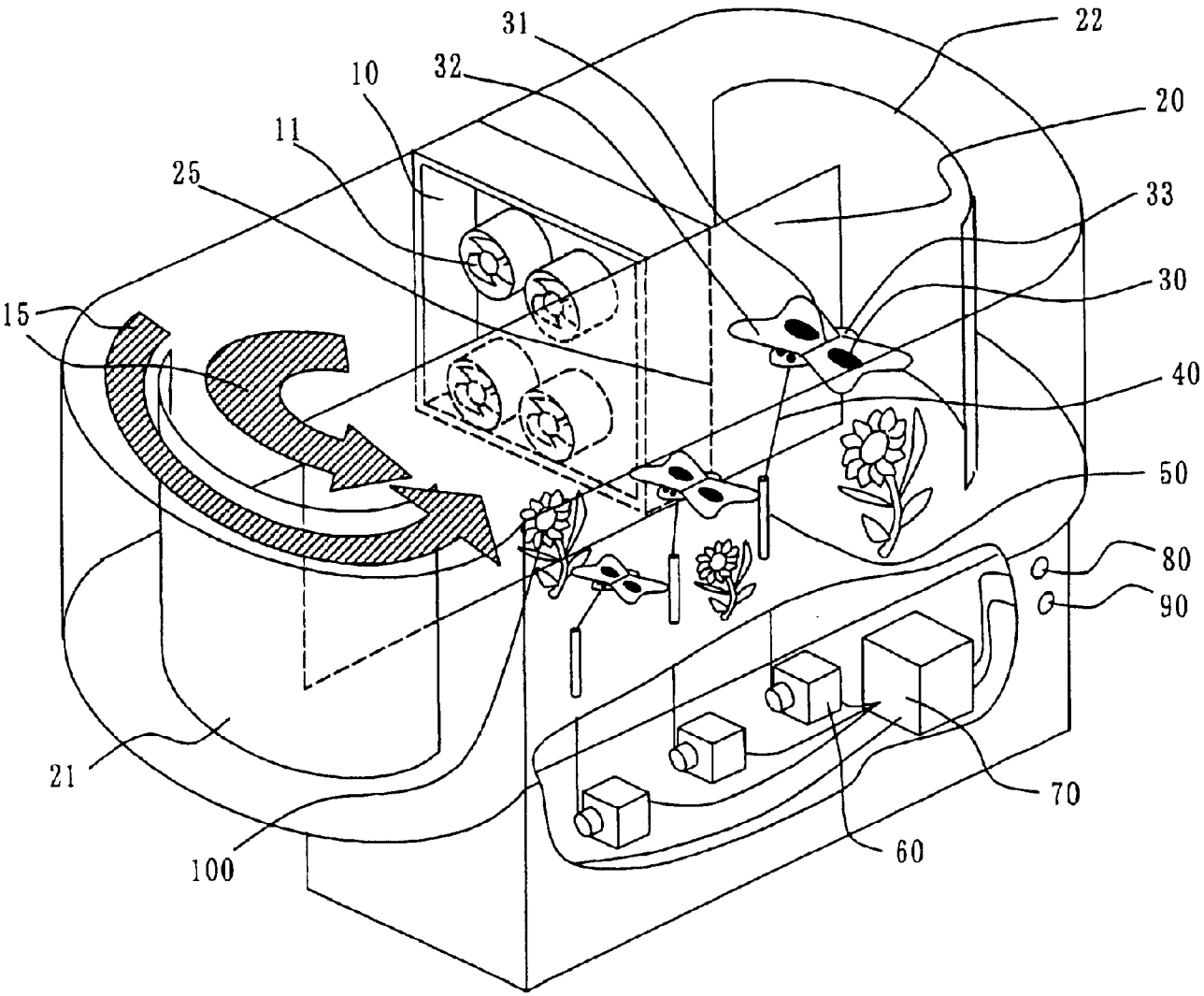
FIG. 1 illustrates a structure of an Embodiment 1 of the present invention.

FIG. 1 illustrates a whole structure of an apparatus for displaying a flying object.

A group 10 of blowers creates an air flow 15 in space in which the flying object flies. It is possible that the group 10 of blowers includes a plurality of blowers 11. It is also possible that the group 10 of blowers includes only one blower 11. Further, the group 10 of blowers can create the air flow 15 by either blowing or drawing gas. It is also possible that a double reverse blower functioning as both a blower with a clockwise rotary fan and a blower with a counter-clockwise rotary fan is provided in the group 10 of blowers.

When there is a flow of rotation in flying space 25, flight itself of a lightweight flying object 30 becomes unstable.

Therefore, it is necessary to set honeycomb rectifier grids etc. in a honeycomb shape in an upstream side in the flying space. When an axial flow blower in a double reverse method or an axial flow blower with a static wing is used as the blower 11, a flow of a direction component of rotation is very little in a blowing flow. Therefore, it is possible to provide the flying space 25 in which the lightweight flying object 30 can fly stably without specially setting rectifier grids.

The air flow 15 is created by the group 10 of blowers. It is possible to fill an inside of a duct with gas besides air. In that case, the air flow 15 is replaced with a flow of the concerning gas.

A duct 20 forms a passage for carrying the gas, e.g., air, etc. The duct forms the space in which the flying object flies. In the duct 20 illustrated in FIG. 1, the air flow 15 in a counterclockwise direction is created. A shape of the duct 20 in FIG. 1 is an example of a space forming unit. It is not necessary that duct 20 is in this shape, and the duct 20 can be in any shape. In FIG. 1, the duct 20 is connected to a drawing side and a blowing side of the group 10 of blowers.

The lightweight flying object 30 flies along the air flow 15 created by the group 10 of blowers in the flying space 25 formed by the duct 20.

As stated, in the apparatus for displaying the flying object in this embodiment, the group 10 of blowers including one or the plurality of blowers 11 is attached to the duct 20 in a circulating method. The air flow 15 sent from the group of blowers 10 is a rectified flow. The air flow 15 flows through a guide blade 21 in an inlet side which is curved by the duct 20, and reaches the flying space 25. Then, the air flow, 15 returns to the group 10 of blowers via a guide blade 22 in an outlet side. As stated, the duct has a circulating structure, and the air flow 15 circulates in the duct 20. Therefore, it is possible to create the air flow 15 which is stable even if the apparatus for displaying the flying object is surrounded by other devices. Accordingly, the lightweight flying object 30 can fly stably.

A holding line 40 is connected to the lightweight flying object 30. A guide unit 50 is a hole for the holding line 40 to move in or out. The holding line 40 is wounded on a spool 60. A controlling unit 70 controls the holding line 40 and the group 10 of blowers in reacting to change in sound and light transferred from a microphone 80 and an optical sensor 90.

The holding line 40 is extended from the lightweight flying object 30 and connected to the spool 60 below the duct 20 through the guide unit 50. The spool 60 is connected to the controlling unit 70, and the controlling unit 70 is connected to the microphone 80 and the optical sensor 90.

A flower 100 which is either real or artificial is placed on a bottom of the duct 20.

The holding line 40 attached to the lightweight flying object 30 is explained.

A line is fixed to an axis 31 of an airframe at two or one points, which is included in a fuselage of the lightweight flying object 30. When the line is fixed at two points, an end of the line is fixed to an upstream point than an aerodynamic center of the lightweight flying object 30, and the other end of the line is fixed to a downstream point. The holding line 40 is attached to a certain point of the line fixed to the axis 31 of the airframe. A position for attaching the holding line 40 can be adjusted. When the line is fixed at one point, the holding line 40 is attached almost to an aerodynamic center of the axis 31 of the airframe directly. The position for attaching the holding line 40 can be changed. When the position is determined once, it is also possible to fix the position.

As stated, the apparatus for displaying the flying object includes the group 10 of blowers for creating the air flow 15 and the duct 20 for forming the flying space. Movement of the lightweight flying object 30 is restricted as the holding line 40 is attached to the lightweight flying object 30. Accordingly, it is possible to make the lightweight flying object 30 fly using the air flow 15 in the space formed by the duct 20. Specifically, since the lightweight flying object 30 is restricted by the holding line 40, it is possible to make the lightweight flying object 30 fly even in small space.

As stated later, the lightweight flying object 30 has an airframe in a small size. Therefore, the lightweight flying object 30 can fly by lift instead of flying by drag like a traditional kite. Hence, it is sufficient if the holding line 40 can sustain tension of approximately a few gf, i.e., several ten mN (millinewton). The holding line 40 can be made of gut or a very thin tungsten wire, etc.

Therefore, the holding line 40 is almost invisible from an outside, and the lightweight flying object looks like floating in the apparatus for displaying the flying object. Consequently, entertainment characteristics as the apparatus for displaying the flying object can be improved.

Next, the controlling unit 70 is explained.

The controlling unit 70 controls the change in the air flow 15 in the duct 20 by changing at least one of a rotation number of the blower 11, a number of blowers 11 operating, and a blowing direction based on a signal from an input device, e.g., the microphone 80, optical sensor 90, etc. attached to the apparatus for displaying the flying object. Further, the controlling unit 70 controls a flying condition of the lightweight flying object 30 by changing a length of the holding line 40 based on the input signal from the input device, e.g., the microphone 80, optical sensor 90, etc. attached to the apparatus for displaying the flying object.

As stated, the controlling unit 70 reacts to a change in surroundings provided externally, and converts the change in the surroundings into a signal. The holding line 40 and the air flow 15 created by the group 10 of blowers are controlled by the converted signal. By controlling this way, an altitude and a flying attitude of the lightweight flying object 30 can be changed. Therefore, the apparatus for displaying the flying object can attract viewers. Further, the entertainment characteristics of this embodiment can be realized. The change in the surroundings provided externally includes all the changes, e.g., change in sound, change in light, change in vibration, change in magnetism, etc., which can be received by the controlling unit 70 as the signal.

The lightweight flying object 30 is explained in details.

The lightweight flying object 30 illustrated in FIG. 1 includes the fuselage which has the axis 31 of the airframe in a center of the flying object. A right wing and a left wing are attached symmetrically with respect to the axis 31 of the airframe included in the fuselage. It is not necessary that a number of the wings is two. It is possible that one wing or a plurality of wings are attached. Further, a strengthening member is joined to the right wing and the left wing for improving strength of the lightweight flying object 30.

A wing surface of the lightweight flying object 30 is made with very light paper or nonwoven fabric with weight of 30 g or less per unit area. On the wing surface, a natural creature, e.g., butterfly, bird, dragonfly, etc. or an artificial object, e.g., aircraft, etc. are printed. In this embodiment, an image of the butterfly is printed. However, any natural object, artificial object, imaginary object, etc. can be printed as far as it is light and appropriate for flying and it can attract viewers.

A plane shape of the lightweight flying object 30 is aerodynamically symmetrical with respect to the axis 31 of the airframe for improving flight stability. For the wing surface of the lightweight flying object 30, lightweight material, e.g., CFRP (Carbon Fiber Reinforced Plastics) or FRP (Fiber Reinforced Plastics) or plastics or cypress, etc. is used as the strengthening member. Structural members are placed mostly in a leading edge part 32 of the wing of the lightweight flying object 30, and is structured to sustain the wing surface in the downstream side of the axis 31 of the airframe. Therefore, the wing can be sustained. A spring component, e.g., CFRP, etc. is bowed and attached to a horizontal timber of the axis 31 of the airframe of the wing for providing a dihedral in the lightweight flying object 30. Because of the dihedral, force for restoring a horizontal flying attitude of the lightweight flying object 30 is produced, and the stability of the lightweight flying object 30 in a roll direction (rotation direction) is increased. Further, a trailing edge part 33 of the lightweight flying object 30 leans upward with respect to the axis 31 of the airframe, and the stability in a pitching direction (vertical direction) is also increased by effect of a tail wing.

When a flying object is heavy, it is necessary that an aerodynamic center and a position of a fine line are almost at a position of gravity to make the flying object stable in the pitching direction. In this case, the center of gravity of the flying object is almost in a middle of the axis 31 of the airframe, and the aerodynamic center is also almost in the middle of the axis 31 of the airframe. Therefore, an angle of attack of the flying object is large, and the flying object goes into a stall and comes to fly by drag.

However, the lightweight flying object 30 in this embodiment is very light, and pitch-up moment due to the gravity is small. Therefore, the angle of attack is reduced, and the aerodynamic center is positioned at a downstream point than the leading edge part 32 of the lightweight flying object 30 by a quarter chord length. It is still stable even when the fine line is moved slightly upstream from the position. Specifically, even though the lightweight flying object 30 is restricted by the holding line 40, the lightweight flying object 30 does not fly by drag like an ordinary kite, but the lightweight flying object 30 can fly by lift.

As stated, the lightweight flying object 30 in this embodiment includes the wing made of lightweight paper, nonwoven fabric, etc. A frame made of CFRP or FRP or plastics or wood, etc. of which strength per weight is high is joined to the wing surface. Therefore, a load of the wing surface can be reduced. Consequently, the lightweight flying object 30 becomes able to fly stably. It is also possible to reduce a minimum flying velocity of the lightweight flying object 30. Accordingly, movement of the lightweight flying object 30 which flutters slowly can give comfort and healing to the viewers. Further, since the lightweight flying object 30 as a whole is in a shape which imitates a natural object, e.g., butterfly, bird, etc. or an artificial object, e.g., aircraft, etc., the viewers get a strong impression on the lightweight flying object 30 which is flying.

Next, gas volume of the air flow 15 created by the group 10 of blowers is explained. The gas volume of the air flow 15 created by the group 10 of blowers is controlled by the controlling unit 70.

Since the apparatus for displaying the flying object is placed in a show window, etc., it is important that the apparatus for displaying the flying object is compact. When a width of a passageway of the duct 20 is approximately. 450 mm which is appropriate for displaying, a span (wingspan) of the lightweight flying object 30 must be approximately ⅓ of the width of the passageway of the duct 20. Otherwise, flight lacks variations, and entertainment effect becomes less. Therefore, when flight of the lightweight flying object 30 with a span of 150 mm and a chord length of approximately 80 mm is assumed, Reynolds number is small as the weight of the lightweight flying object 30 is light. Hence, maximum lift coefficient is approximately 0.5. When the wing surface is made of nonwoven fabric of 40 g/m$^2$ and a weight of a frame of the structural member is 1.3 g, a total weight L of the lightweight flying object 30 is approximately 1.8 g. Therefore, when a density of the air is p, a capacity coefficient is CL, and a section of the passageway of the air flow 15 is S, a minimum velocity U of the air flow 15 flowing through the duct 20, which is necessary for making the lightweight flying object 30 fly, can be obtained using the following equation:

$$U=(2\times L\times 9.8/(\rho\times CL\times S))^{0.5}$$

By substituting

L (total weight of the lightweight flying object 30)= 0.0018 [kg]

$\rho$=1.2 [kg/m$^3$]

CL=0.5

S(span×chord length of light weight flying object)=0.15× 0.08 [m$^3$]in the above equation, $U=(2\times 0.0018\times 9.8/(1.2\times 0.5\times 0.15\times 0.08)^{0.5}1.5$ [m/sec]

Therefore, a low velocity is sufficient. Specifically, the minimum velocity U of the air flow 15 for making the lightweight flying object 30 fly is sufficient at 1.5 m per second.

When a height H of the duct 20 is 600 mm and a width W of the passageway of the air flow 15 of the duct 20 is 45 mm, gas volume N of the group 10 of blowers is obtained as follows:

$$\begin{aligned} N &= U\times W\times H \ [\mathrm{m^3/sec}] \\ &= 1.5\times 0.45\times 0.6\times 60 \ [\mathrm{m^3/min}] \\ &= 24 \ [\mathrm{m^3/min}] \end{aligned}$$

Therefore, the gas volume N at 24 m$^3$ per minute is sufficient, and it is possible to make the lightweight flying object 30 fly by the blower 11 in a small size, e.g., ventilator.

As stated, the weight of the lightweight flying object 30 is reduced, and the lightweight flying object 30 becomes able to fly even at low gas volume. Therefore, the lightweight flying object 30 can fly softly by lift, and it becomes possible to reduce a noise of the group 10 of blowers.

Next, a control method by the controlling unit 70 using the microphone 80 and the optical sensor 90 is explained.

The controlling unit 70 converts a change of sound and a change of light into a signal, and controls the spool 60 for adjusting the length of the holding line 40 based on the converted signal. Further, the controlling unit 70 adjusts the air flow 15 by changing a rotation number of the blowers 11, a number of blowers operating, timing of operation of each of blowers 11 in the group 10 of blowers, etc. According to this function, the length of the holding line 40 is changed in reacting to clapping by the viewers or rotary spot light, and an altitude of flight and a flight attitude of the lightweight flying object 30 can be changed. Further, by changing the rotation number of the blowers 11 and the number of blowers operating, velocity of the air flow 15 flowing toward the lightweight flying object 30 is changed, and the lift of the lightweight flying object 30 is changed. Accordingly, an angle of inclination of the holding line 40 is changed, and a flowing direction position and the altitude of flight of the lightweight flying object 30 can be changed. Further, movement of flying can be synchronized with music and lighting by a random signal provided externally. It is also possible that the movement of flying can be synchronized with music and lighting by sending a signal from the controlling unit 70 to the spool 60 of the holding line and the blower 11 based on a predetermined sequence.

As stated, the altitude and the flying attitude of the lightweight flying object 30 can be changed using an external signal by changing the length of the holding line 40 by the controlling unit 70 based on the signal from an input device, e.g., the microphone 80, optical sensor 90, etc. attached to the apparatus for displaying the flying object.

The altitude and the flying attitude of the lightweight flying object 30 can be also changed using the external signal by changing the rotation number of the blower 11, the number of blowers 11 operating, and a blowing position by the controlling unit 70 based on the signal from the input device, e.g., the microphone 80, optical sensor 90, etc. attached to the apparatus for displaying the flying object.

Further, by changing the length of the holding line 40, rotation of the blower 11, and a blowing position in reacting to music from a speaker or lighting accompanied by the apparatus for displaying the flying object, it becomes possible to make the lightweight flying object 30 dance suitably for a situation of people gathering in a display place. Hence, the entertainment characteristics of the lightweight flying object 30 can be improved.

Next, takeoff of the lightweight flying object 30 using a guide unit 50 is explained.

Before takeoff, the lightweight flying object 30 is in the bottom of the duct 20, where velocity of the air flow 15 is low. Hence, for making the lightweight flying object 30 take off, it is necessary to move the lightweight flying objet 30 to an area in a middle of the duct 20, where the velocity of the air flow 15 is high. The lightweight flying object 30 takes off in the following sequence.

As illustrated in FIG. 1, the holding line 40 passes through an inside of the guide unit 50 extended from a bottom of the duct 20 toward the flying space 25. At takeoff, the holding line 40 is wound by the spool 60, and the lightweight flying object 30 is moved up from the bottom of the duct 20 to a top of the guide unit 50. Since the velocity of the air flow 15 at the top of the guide unit 50 is high, the lightweight flying object 30 can start flying at this moment. When the flight of the lightweight flying object 30 becomes stable, the length of the holding line 40 is made longer by the spool 60 of the holding line, and the lightweight flying object 30 starts flying freely in the duct 20. The guide unit 50 can have any structure, e.g., pipe shape as illustrated in FIG. 1, a shape including a bar and a ring at an end of the bar, which is not illustrated, etc. as far as a fulcrum is provided for the holding line 40. For example, the guide unit 50 can be in a shape of a frog or a praying mantis. In this case, by making the guide unit 50 in the shape of the frog move almost to eat the lightweight flying object 30 in a shape of a butterfly, the apparatus for displaying becomes more attractive.

In FIG. 1, the guide unit 50 is fixed to the duct 20. However, a height of the guide unit 50 can be variable. For example, it is possible to operate the guide unit 50 vertically by making a hole on a bottom of the duct 20 in which the guide unit 50 is set. When the guide unit 50 itself has an elastic structure like a spring, it is possible to operate the guide unit 50 vertically without making the hole on the bottom of the duct 20.

As stated, the top of the guide unit 50 extended from the bottom of the duct 20 to an inside of the space formed by the duct 20, which is fixed or can be operated vertically, is provided as the fulcrum for the holding line 40, and the lightweight flying object 30 can start flying from the fulcrum. Therefore, at an initial stage of flight sequence, the lightweight flying object 30 can move to a middle part of the air flow 15 in the duct 20 using the guide unit 50, and the lightweight flying object 30 can take off easily. Further, by moving the guide unit 50 higher at takeoff and moving the guide unit 50 lower after transition to flying, the flying space 25 of the lightweight flying object 30 can be increased. Accordingly, flight airspace of the lightweight flying object 30 can be increased.

Next, a structure of the duct 20 illustrated in FIG. 1 is explained in details.

In FIG. 1, the duct 20 is connected to a drawing side and a blowing side of the group 10 of blowers. Specifically, the group 10 of blowers is set in the space formed by the duct 20, and the air flow 15 created by the group 10 of blowers is circulated in the inside of the duct 20. In the duct 20, the guide blade 21 in the inlet side is provided in the upstream side and the guide blade 22 in the outlet side is provided in the downstream side. Then, the duct is further connected to the group 10 of blowers. Since a passage of gas is closed in this structure, a stable flow can be created even if any kind of obstacle exists in an outside the apparatus for displaying the flying object.

When there is a flow of rotation in the flying space 25, flight itself of the lightweight flying object 30 becomes unstable. Therefore, it is necessary to set honeycomb rectifier grids etc. in a honeycomb shape in an upstream side in the flying space. When an axial flow blower in a double reverse method or an axial flow blower with a static wing is used as the blower 11, a flow of a direction component of rotation is very little in a blowing flow. Therefore, it is possible to provide the flying space 25 in which the lightweight flying object 30 can fly stably without setting rectifier grids specially.

By setting the flower 100 in the duct 20 in the apparatus for displaying the flying object according to this embodiment, it is possible to compose a scene as if the lightweight flying object 30 imitating a creature, e.g., butterfly plays around the flower. Further, by making the flower 100 controllable using an external signal or based on a determined sequence the same as the lightweight flying object 30, a lean and a direction of the flower 100 can be changed. Accordingly, the entertainment effect can be improved.

Embodiment 2.

Figure 2:
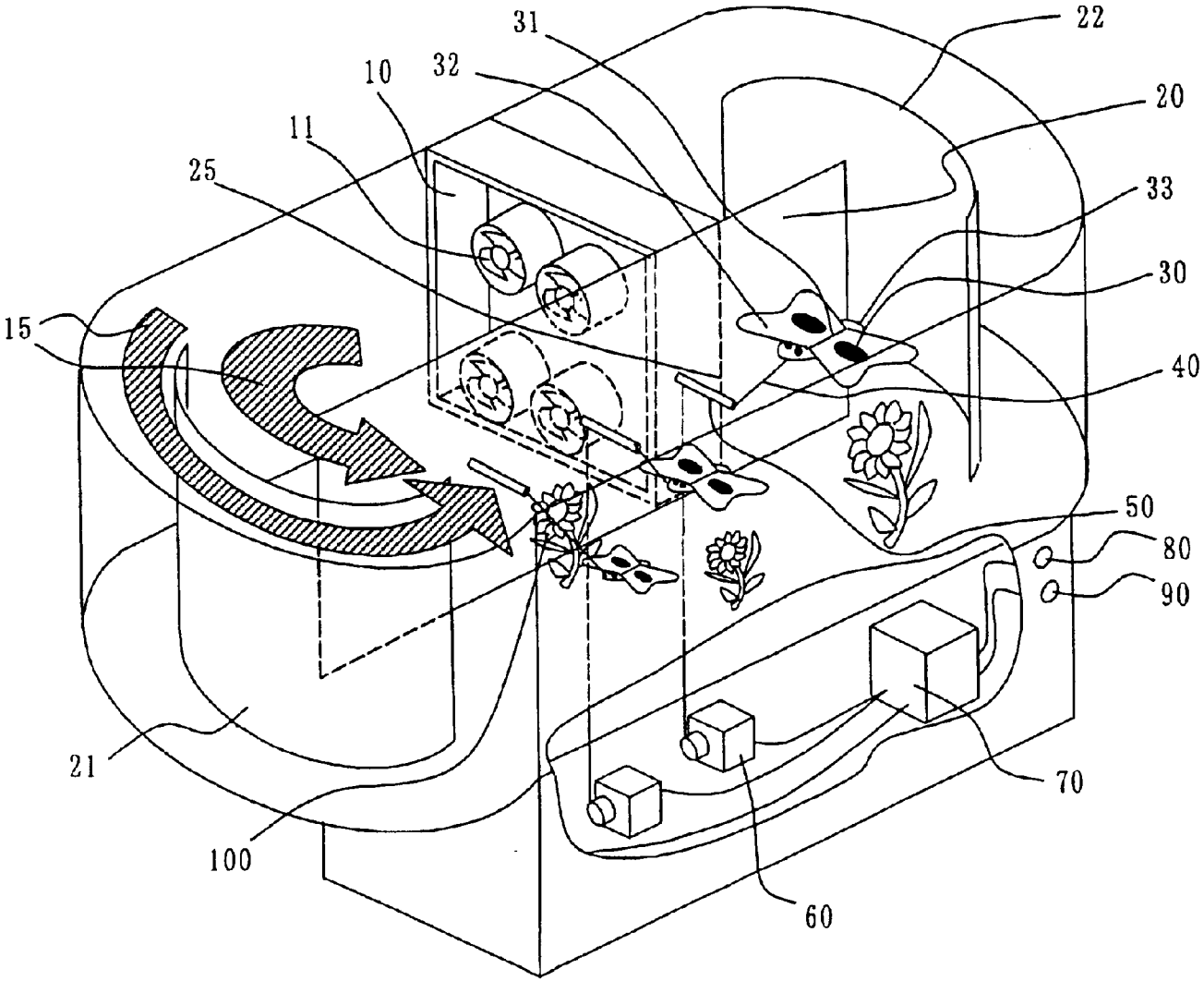
FIG. 2 illustrates a structure of an Embodiment 2 of the present invention.

FIG. 2 illustrates this embodiment.

In FIG. 2, the guide unit 50 is attached to a wall for forming a passageway of the air flow 15 in the middle of the duct 20 so that the guide unit 50 is parallel to the bottom of the duct 20. In this case, the guide unit 50 is fixed or can be operated back and forth or vertically. Further, it is not necessary that all of the guide units 50 are set at a same height on a side surface of the duct. Further, the guide units 50 can be set on both the side surface and the bottom. Other composition is same as FIG. 1. Since explanations have been made in Embodiment 1, the explanations are omitted.

In this embodiment, the top of the guide unit 50 is set as a fulcrum, and the lightweight flying object 30 can start flying from the fulcrum. Therefore, the lightweight flying object 30 can move to the middle of the air flow 15 in the duct 20 using the guide unit 50, and take off from the middle of the air flow 15. Hence, it becomes possible to fly smoothly. Further, at takeoff, the guide unit 50 is extended, and after transition to flying, the guide unit 50 is shortened, or the guide unit 50 is moved down or up. Accordingly, the flying space 25 of the lightweight flying object 30 can be increased. Further, when the guide unit 50 is extended from the side surface toward the front, the viewers who look at the lightweight flying object 30 in the apparatus for displaying the flying object from the front are less conscious of the guide unit 50 and the holding line 40 compared with a case in which the guide unit 50 is extended from the bottom. Therefore, appreciation effect is improved.

Embodiment 3.

Figure 3:
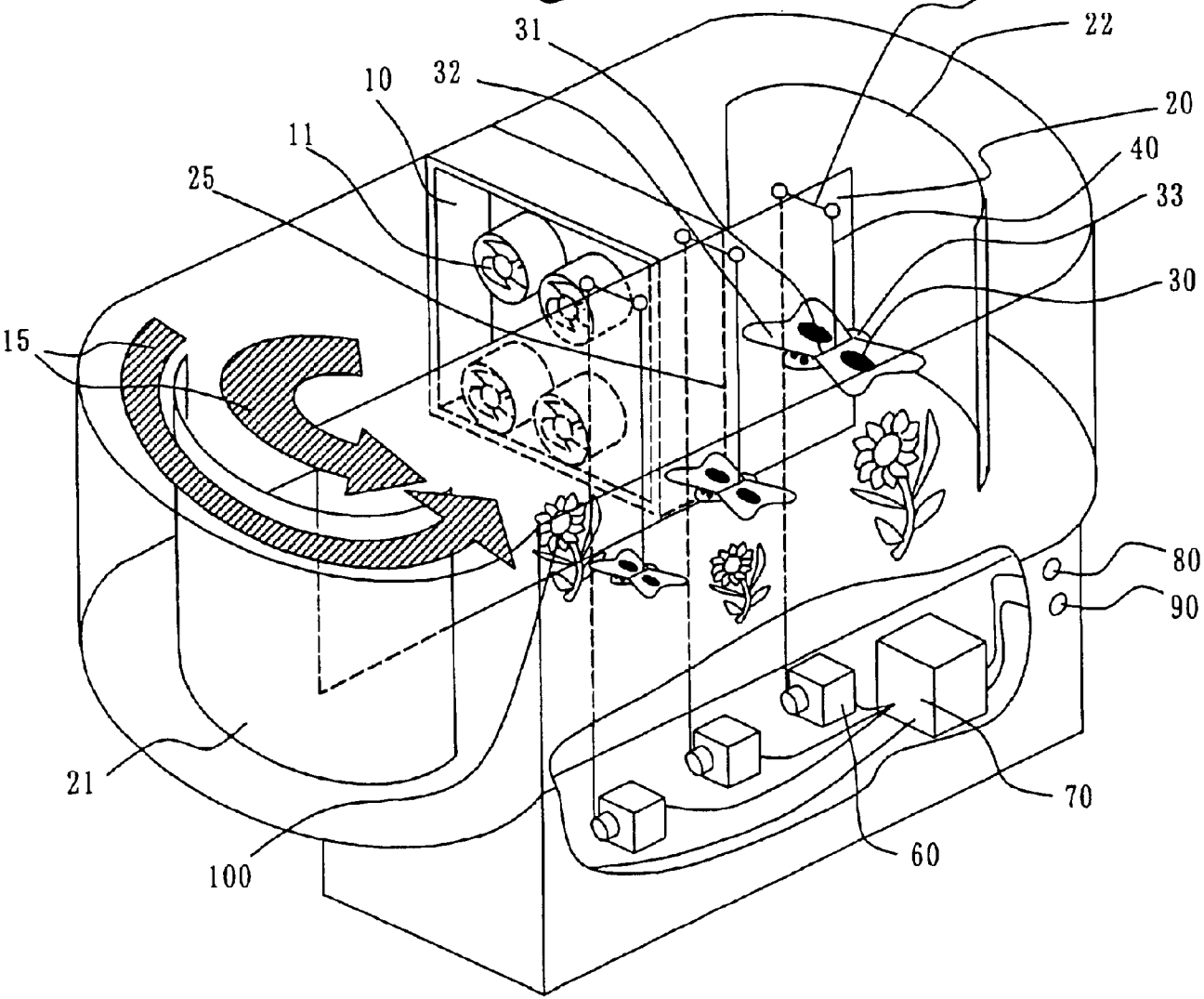
FIG. 3 illustrates a structure of an Embodiment 3 of the present invention.

FIG. 3 illustrates this embodiment.

In FIG. 3, the guide unit 50 includes two spheres connected by a bar. The guide unit 50 is attached to a top of a wall for forming a passage of the air flow 15 in the middle of the duct 20 so that the guide member is parallel to the bottom of the duct 20. There are through-holes in the spheres at both ends of the bar so that the holding line 40 can be passed through. The holding line 40 is connected to the lightweight flying object 30 through the spheres at both ends of the bar. One of the spheres functions as a fulcrum of the flight of the lightweight flying object 30. In this case, the guide unit 50 can be also fixed or can be operated back and forth or vertically. Further, it is possible to mix a method for setting the guide unit 50, illustrated in FIG. 3 and a method for setting the guide unit 50, illustrated in FIGS. 1 and 2. Other composition is same as FIG. 1. Since explanations have been made in Embodiment 1, the explanations are omitted.

In this embodiment, the holding line 40 is connected to the lightweight flying object 30 through the guide unit 50. Therefore, the lightweight flying object 30 is moved to the middle of the duct 20 in height by the holding line 40. Accordingly, the lightweight flying object 30 can start flying smoothly. Further, at takeoff, the guide unit 50 is extended, and after transition to flying, the guide unit 50 is shortened or moved down. Accordingly, the flying space 25 of the lightweight flying object 30 can be increased. Further, when the guide unit 50 is extended from the side surface, the viewers who look at the lightweight flying object 30 in the apparatus for displaying the flying object from the front are less conscious of the guide unit 50 and the holding line 40 compared with a case in which the guide unit 50 is extended from the bottom. Therefore, appreciation effect is improved.

Embodiment 4.

Figure 4:
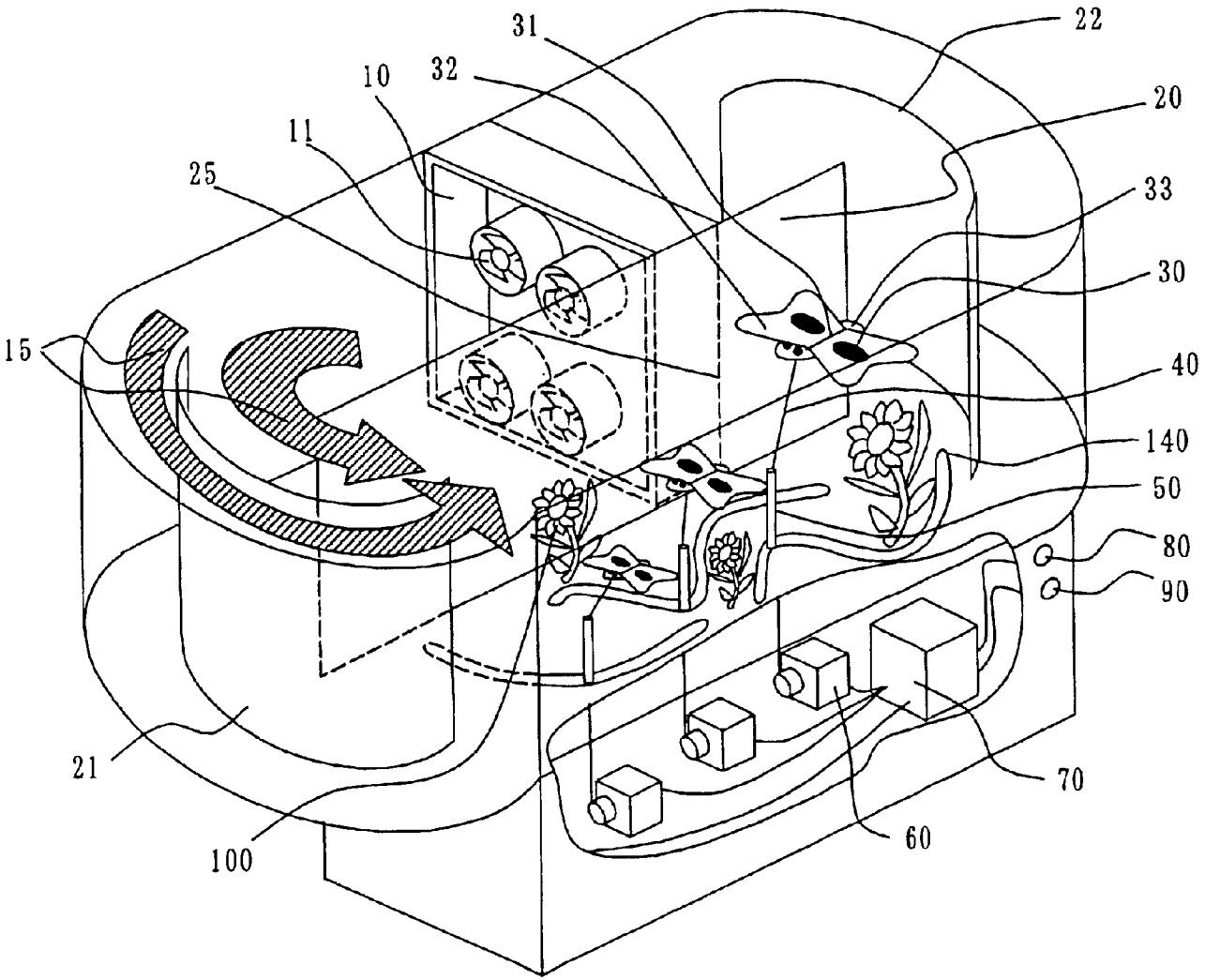
FIG. 4 illustrates a structure of an Embodiment 4 of the present invention.

FIG. 4 illustrates this embodiment.

In FIG. 4, a groove 140 for moving is provided in each of the guide units 50 so that the guide units 50 can move on the bottom. Other composition is same as FIG. 1. Since explanations have been made in Embodiment 1, the explanations are omitted.

As stated, in this embodiment, the guide unit 50 can move vertically and move on a surface of the bottom using the groove 140 for moving. Therefore, a position of each of the lightweight flying objects 30 can be changed by movement of the guide unit 50 on the surface of the bottom in addition to controlling the gas volume.

Accordingly, it is possible to improve the entertainment characteristics as the apparatus for displaying the flying object. Further, by extending the groove 140 for moving to a side of the group 10 of blowers of the wall for forming the passage of the air flow 15 in the middle of the duct 20, it becomes possible that the lightweight flying object 30 is seen off and on because of the wall. Therefore, there is effect of surprising and attracting the viewers more.

Embodiment 5.

Figure 5:
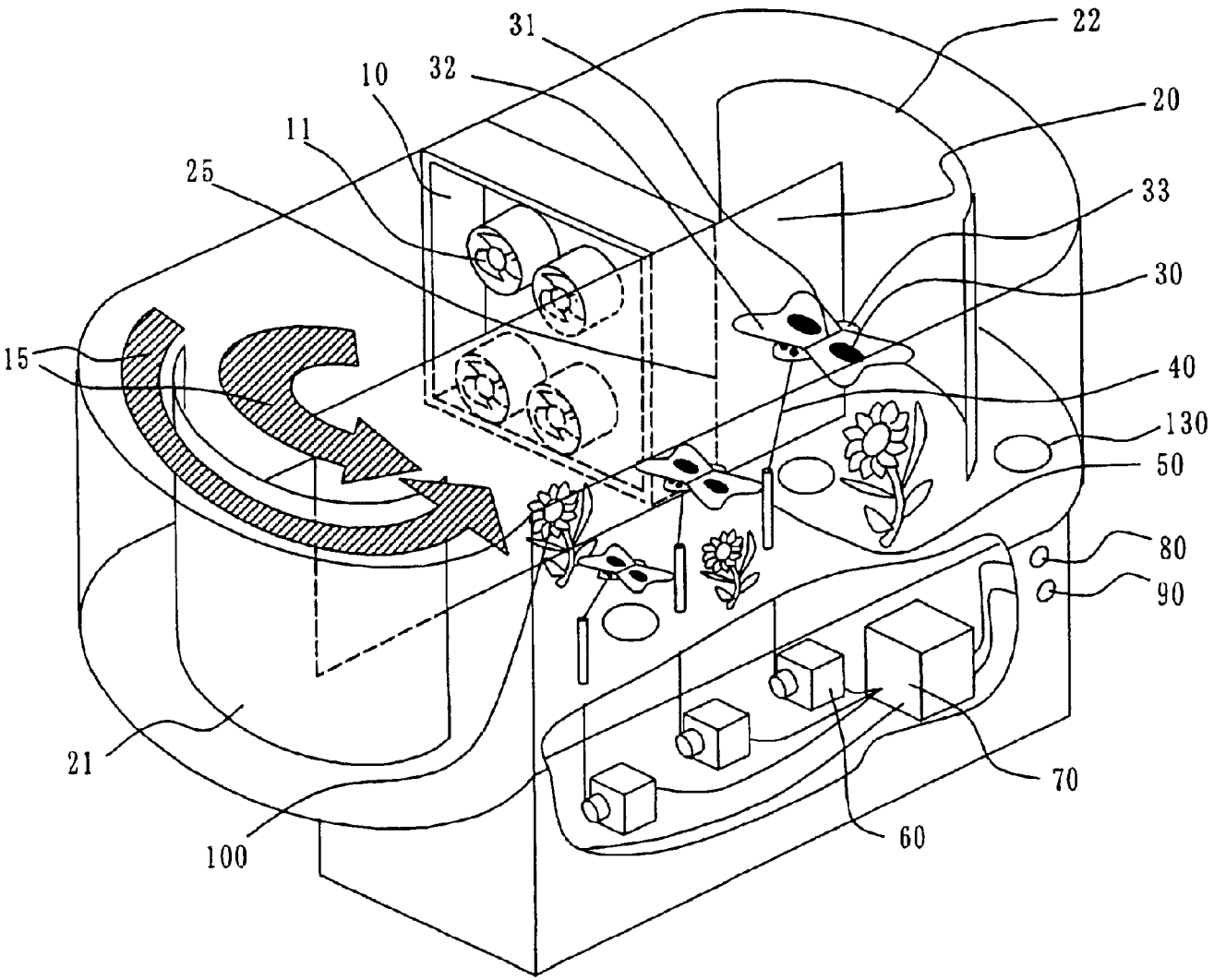
FIG. 5 illustrates a structure of an Embodiment 5 of the present invention.

FIG. 5 illustrates this embodiment.

In FIG. 5, an air hole 130 is provided on the bottom of the duct 20. Other composition is same as FIG. 1. Since explanations have been made in Embodiment 1, the explanations are omitted. The air flow 15 in the duct 20 comes in or out through the air hole 130. Further, it is possible to send the air flow 15 and smoke by dry ice, etc. into the duct 20 constantly or temporally through the air hole 130.

Further, it is also possible that the air hole 130 can be opened and closed. Besides the air hole 130 on the bottom of the duct 20 as illustrated in FIG. 5, the air hole 130 can be provided on the side surface of the duct 20, and the air in the duct 20 can be exchanged with the air in the outside constantly or temporally through the air hole 130.

As stated, since the air flow 15, etc. comes in or out through the air hole 130 in the duct 20, it is possible to add variations to the air flow 15 in the duct 20. Therefore, it becomes possible to add variations to the flight of the lightweight flying object 30 and produce effect of the dry ice, etc.

Embodiment 6.

Figure 6:
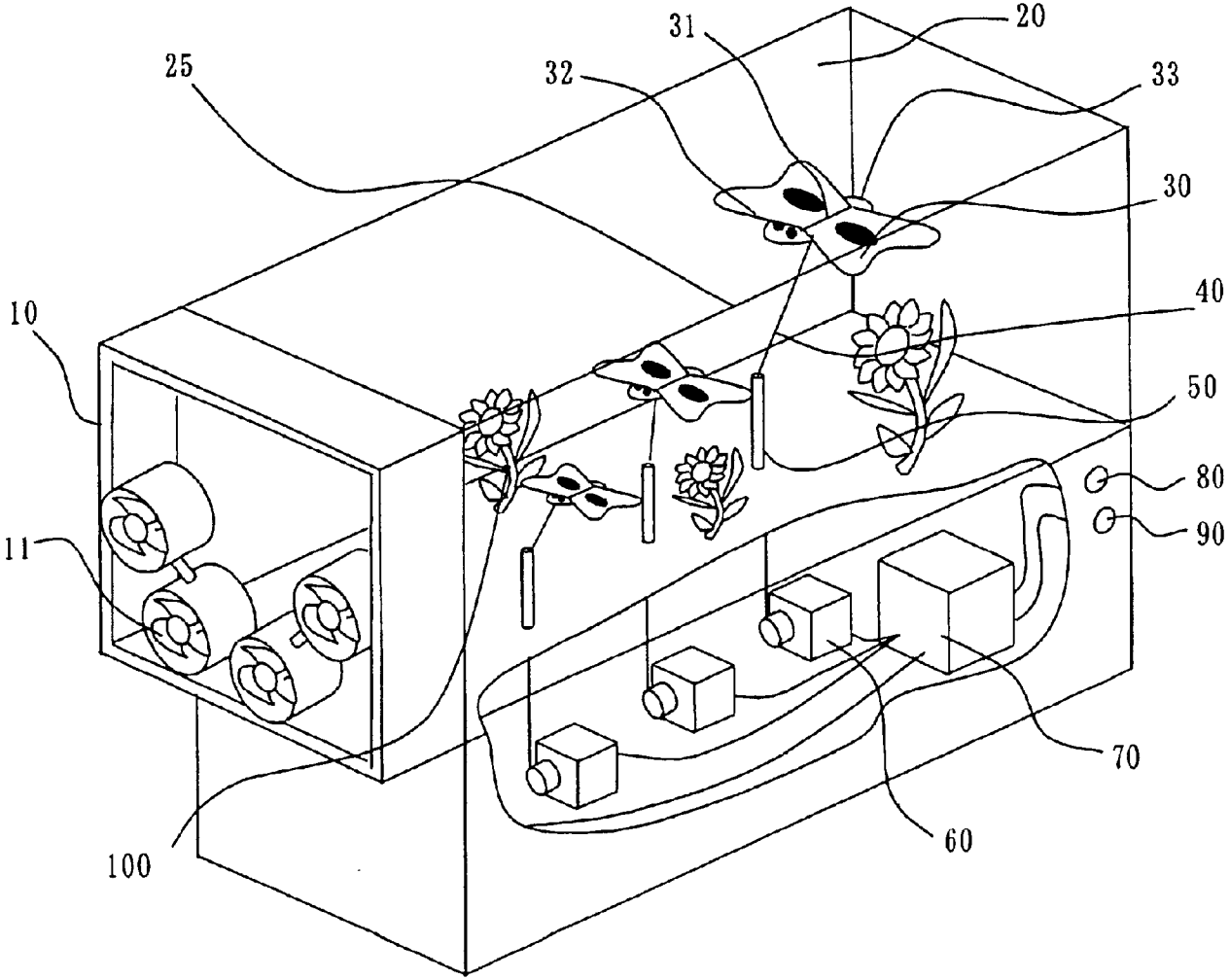
FIG. 6 illustrates a structure of an Embodiment 6 of the present invention.

FIG. 6 illustrates this embodiment.

In the apparatus for displaying the flying object illustrated in FIG. 6, same numbers are used for same devices which are illustrated in FIG. 1. Since the same devices have been explained earlier, explanations are omitted. In this embodiment, the drawing side and the blowing side of the group 10 of blowers are not linked to the duct 20, and the apparatus for displaying the flying object is an open type. The group 10 of blowers is set in the upstream side of the flying space 25. In this structure, it is not necessary to set the group 10 of blowers behind the duct 20. Therefore, there is an advantage of reducing a size of the apparatus for displaying the flying object.

For making the lightweight flying object 30 fly stably by a limited number of blowers 11, it is necessary to rectify the flow by providing rectifier grids and a rectifier net in the blowing side of the group 10 of blowers. However, for setting the apparatus for displaying the flying object in a limited space, it is desirable to reduce a length in a flowing direction. Therefore, a method for setting the group 10 of blowers appropriately for stabilizing the flight of the lightweight flying object 30 is explained in the following.

In this example, the double reverse blower is used as the blower 11. The blower 11 has a clockwise rotary fan which is not illustrated behind a counterclockwise rotary fan which is illustrated in FIG. 6. The group 10 of blowers has four blowers 11. Among four blowers 11, two inner blowers are placed lower than two outer blowers. Looking from a blowing direction of the group 10 of blowers, the blowers 11 are arranged in a shape of an inverted trapezoid.

Figure 9:
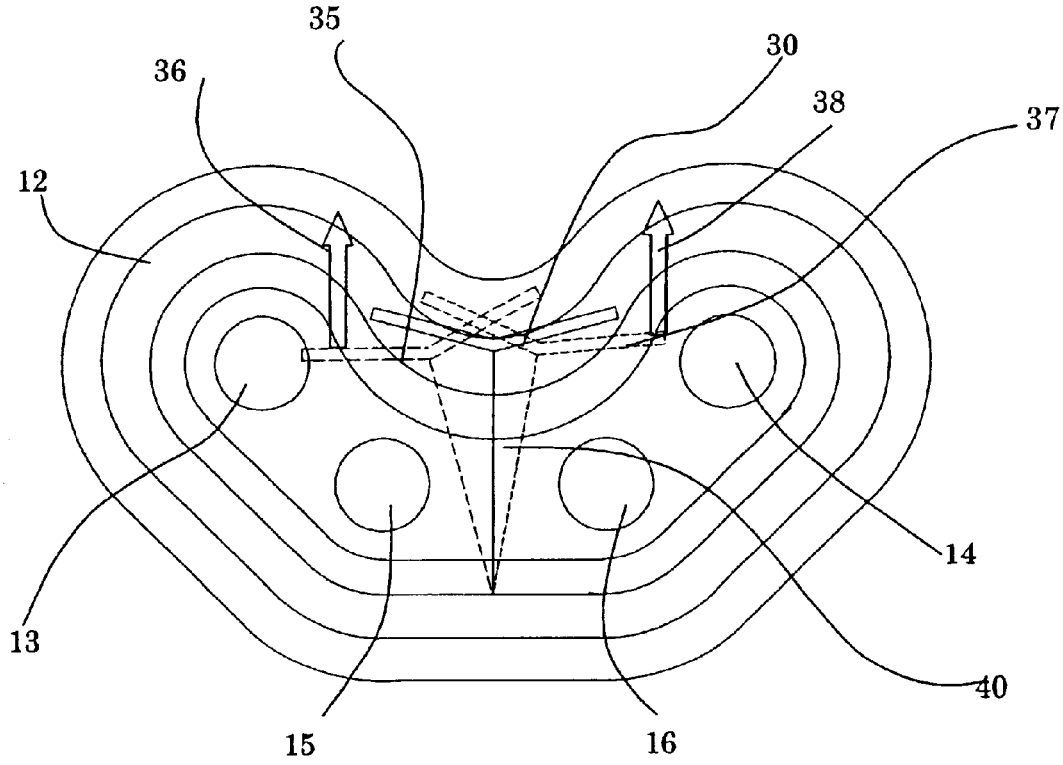
FIG. 9 illustrates velocity contour lines showing the distribution of the velocity of air blowing from a blower.
Figure 10A:
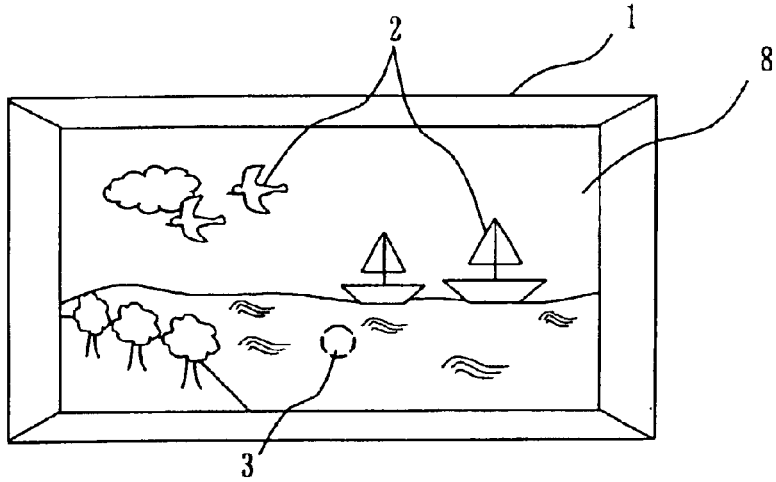
Fig.10A RELATED ART
FIG. 10A, FIG. 10B, and FIG. 10C illustrate related art structures.
Figure 10B:
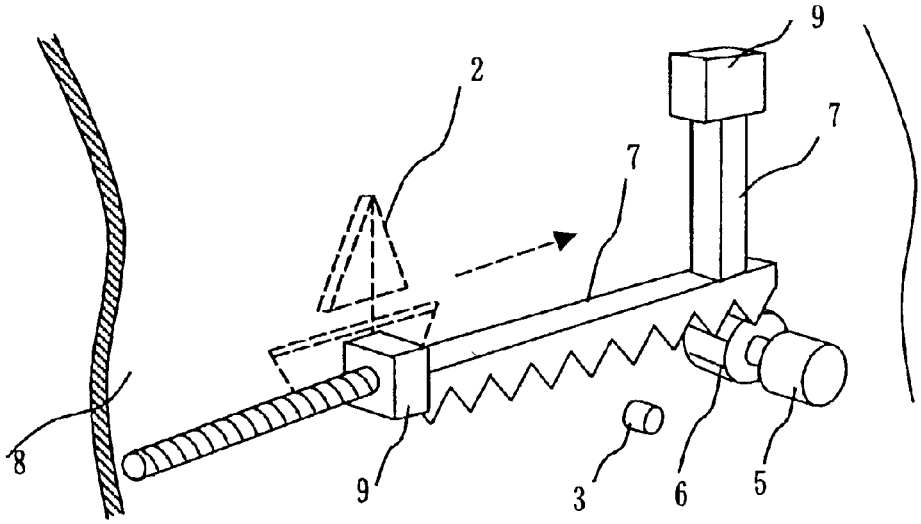
Fig. 10B RELATED ART
Figure 10C:
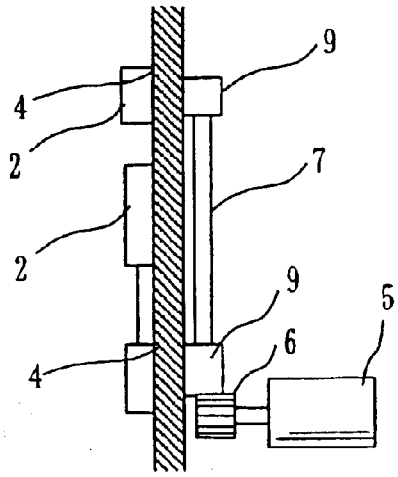
Fig. 10C RELATED ART

FIG. 9 illustrates velocity contour lines 12 for showing distribution of velocity of flow in an axial direction of the airframe, blown from the group 10 of blowers arranged in the shape of the inverted trapezoid. In the flows blown from each of the blowers 11, velocity of each of flows 13, 14, 15, and 16 is most rapid. The flows 13, 14, 15, and 16 are also arranged in the shape of the inverted trapezoid.

Next, a case in which the lightweight flying object 30 leans from a neutral position toward a left side and exists in a position 35 of leaning toward the left side is assumed. In a normal aircraft, when the airframe leans, a sideslip is caused toward the leaning direction. Synthesis velocity of sideslip velocity and main velocity acts on a leaned wing and increases the lift. Then, the airframe restores a stable state by moment in a direction of restoring from leaned position. Since movement of the lightweight flying object 30 is restricted by the holding line 40, the velocity of sideslip due to leaning of the airframe is low. Hence, moment for restoring is also low. When the blowing flow is in the shape of the inverted trapezoid, the velocity which acts on the leaned wing is increased. Hence, when the lightweight flying object 30 leans toward the left side, large moment 36 for restoring is produced. By the moment for restoring, the lightweight flying object 30 can return to a stable position easily. When the lightweight flying object 30 leans toward the right side and exists in a position 37 of leaning toward the right side, moment 38 for restoring is also produced, and the lightweight flying object 30 can return to a stable position.

Arrangement of the group 10 of blowers in the shape of the inverted trapezoid has been explained for a case of the apparatus for displaying the flying object in the open type. However, same effect can be realized in the apparatus for displaying the flying object in a closed type, in which the duct is linked to the drawing side and the blowing side of the blower as illustrated in FIG. 1.

As stated, the group 10 of blowers includes three or four blowers 11. The inner blower 11 is placed lower than the outer blowers. Accordingly, a sectional shape of the flow from the group 10 of the blowers is in a shape of a valley with a low middle part and high left and right side parts. Therefore, when the lightweight flying object 30 is flied in the bottom of the valley, the stability of the flying attitude in the horizontal direction can be increased.

Figure 7:
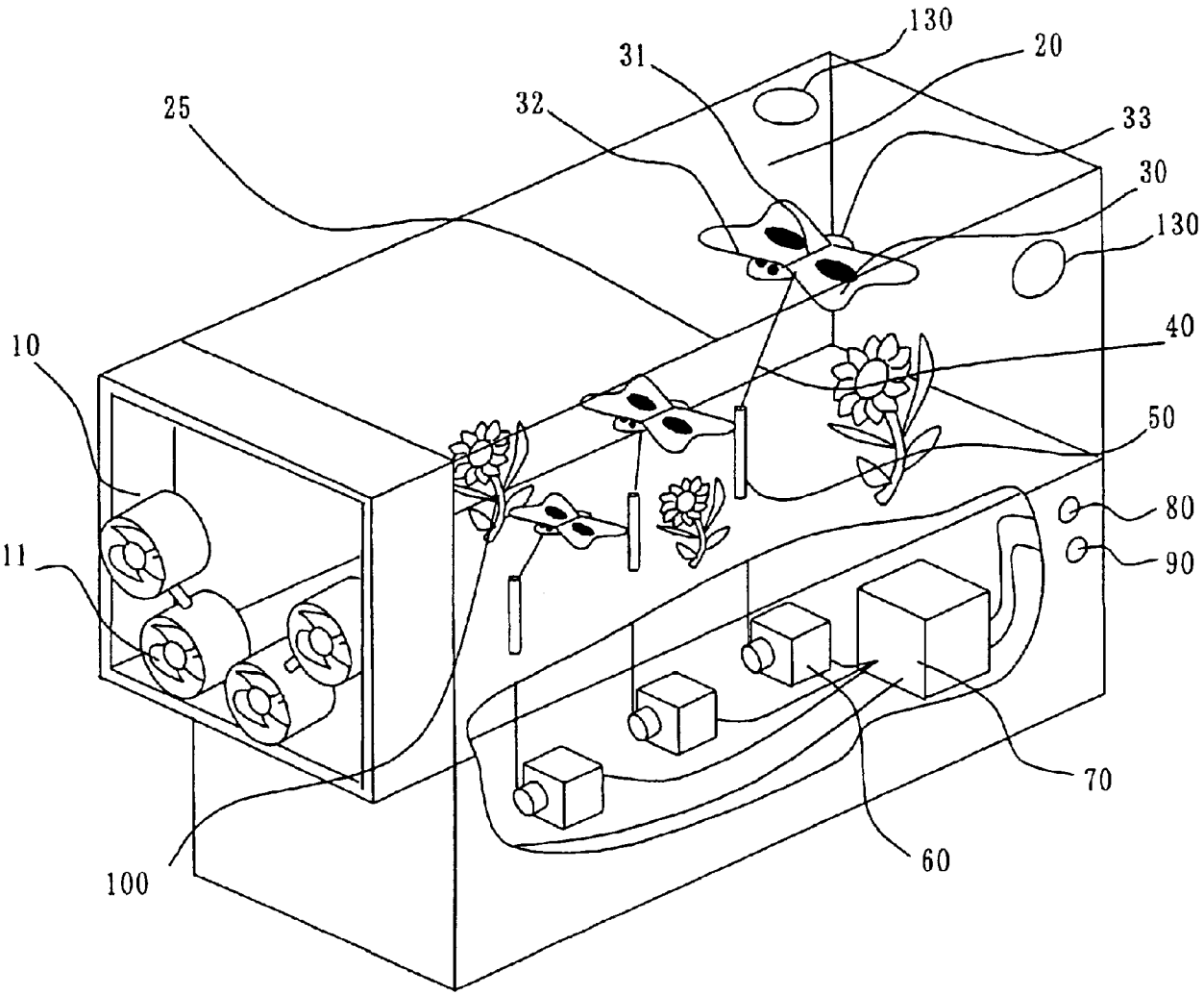
FIG. 7 illustrates a structure to which an air hole is added to the structure of Embodiment 6.

In FIG. 7, the air holes 130 are provided on the side surface and an upper surface of the duct 20. The air flow 15 in the duct 20 comes in or out through the air holes 130. It is possible to send the air flow 15 constantly or temporally into the duct 20 through the air hole 130. It is also possible that the air hole 130 can be opened and closed. Besides the air hole 130 on the side surface and the upper surface of the duct 20 as illustrated in FIG. 7, the air hole 130 can be provided on the bottom of the duct 20.

Accordingly, since the air flow 15, etc. comes in or out through the air hole 130 in the duct 20, it is possible to add variations to the air flow 15 in the duct 20. Therefore, it becomes possible to add variations to the flight of the lightweight flying object 30.

Embodiment 7.

Figure 8:
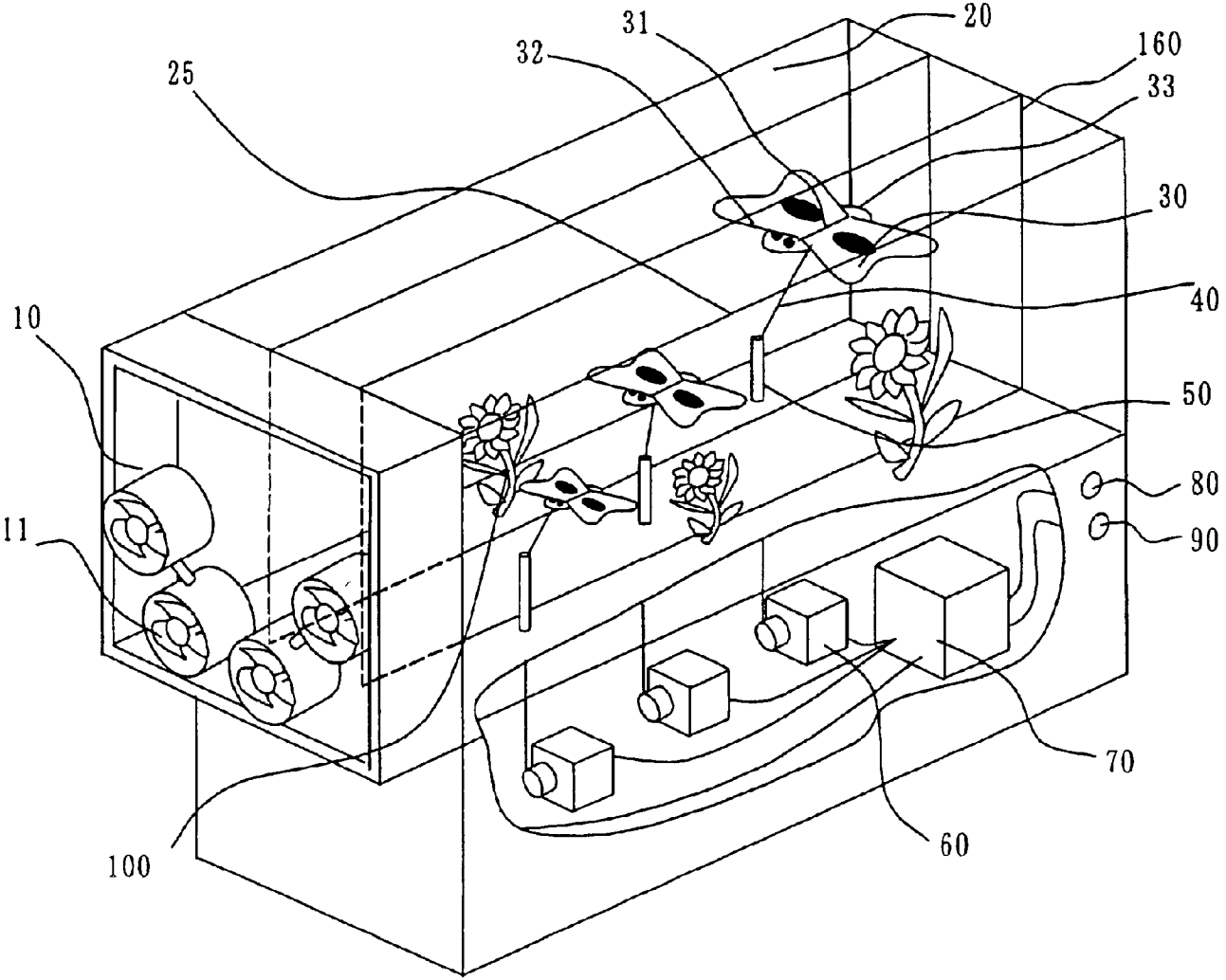
FIG. 8 illustrates a structure of an Embodiment 7 of the present invention.

FIG. 8 illustrates this embodiment.

In the apparatus for displaying the flying object illustrated in FIG. 8, a partition 160 for dividing the space of the duct 20 into a plurality of sub-spaces is added to the devices included in FIG. 6. Other composition besides the partition is same as FIG. 6. Therefore, explanations are omitted.

As illustrated in FIG. 8, by dividing the space in the duct 20 into a plurality of sub-spaces by the partition 160, it becomes possible to change the air flow 15 created in each of the sub-spaces respectively for each of the subspaces using the group 10 of blowers and the air hole 130, etc. which is not illustrated. Hence, when the lightweight flying objects exist in each of the spaces divided by each of the partitions 160, it is possible to move each of the lightweight flying objects 30 separately. Therefore, the viewers can enjoy completely different flight by each of the lightweight flying objects 30. Further, by making the partition 160 with transparent glass or plastic, the viewers become unconscious of the partition 160. In this case, the viewers can enjoy the various flight of the lightweight flying object 30 without noticing mechanism of the partition 160. Accordingly, it is possible to provide the apparatus for displaying the flying object which can attract the viewers even more.

Further, a story is painted as a background on a wall in a front side of the partition 160, and the partition 160 can be operated vertically or structured like bellows which can be folded. Accordingly, it becomes possible to make the plurality of lightweight flying objects 30 enter or leave by placing or withdrawing one partition 160. For example, in Christmas season, a reindeer in a sub-space in a first row from the front, Santa Claus in a subspace in a second row, and a lot of snow in a sub-space in a third row, which are the lightweight flying objects 30, are entered or left, and it is possible to add story characteristics to the apparatus for displaying the flying object. Hence, it becomes possible to attract the viewers more and display suitably for seasons and situations.

In this embodiment, the flying object can fly variously.

In this embodiment, since the flying object is restricted by the line, it is possible to make the flying object fly in a small space in the duct.

In this embodiment, the load of the wing surface can be reduced by using lightweight paper or a frame of which strength per weight is high, and the stability of flight of the flying object can be increased. Further, the minimum flying velocity can be lowered.

In this embodiment, the altitude of the flying object and the flying attitude can be changed by the external signal.

In this embodiment, the flying object can fly in reacting to the music and lighting.

In this embodiment, when the flying object flies, it is possible to increase the stability of the flying attitude in the horizontal direction.

In this embodiment, since the flow component of rotation is little in the flows from the group of blowers, it is possible to prevent the flying attitude of the flying object from being disordered.

In this embodiment, in the initial stage of flight sequence, the flying object moves to a middle part of the flow in the duct using the fulcrum, and the flying object can take off easily.

In this embodiment, since the air flow is circulated in the duct, the stable air flow can be created even if the apparatus for displaying the flying object is surrounded by another device.

In this embodiment, a circulating part is not necessary. Therefore, a size of the apparatus for displaying the flying object as a whole can be reduced.

In this embodiment, it becomes possible to add variations to the flight of the flying object.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. An apparatus for displaying a flying object comprising:

a space forming unit defining a flying space;

a blower for creating an air flow in the flying space;

a flying object for flying in response to the air flow in the flying space;

a connecting unit connected to the flying object, including a holding line restricting the flying object in the flying space; and a controlling unit for controlling flying of the flying object by changing length of the holding line.

2. The apparatus for displaying the flying object of claim 1, wherein the controlling unit controls at least one of the length of the holding line and the air flow in reacting to a change in external surroundings of the apparatus.

3. The apparatus for displaying the flying object of claim 2, wherein the controlling unit controls at least one of the length of the holding line and the air flow in reacting to at least one of sound and light.

4. The apparatus for displaying the flying object of claim 1, wherein the controlling unit controls at least one of the length of the holding line and the air flow based on a signal.

5. The apparatus for displaying the flying object of claim 1, wherein the blower creates the air flow by rotating a fan blade, and the controlling unit controls the flying of the flying object by changing the air flow by controlling at least one of rotation rate, rotation direction, and timing of rotation of the fan blade.

6. The apparatus for displaying the flying object of claim 1, further comprising at least three blowers arranged serially so that an inner blower is positioned lower than outer blowers.

7. The apparatus for displaying the flying object of claim 1, wherein the blower is a double reverse blower.

8. The apparatus for displaying the flying object of claim 1, wherein the connecting unit includes a guide unit in the flying space having a hole which the holding line passes through, and the flying object flies with an edge of the guide unit as a fulcrum.

9. The apparatus for displaying the flying object of claim 8, wherein the connecting unit changes position of the edge of the guide unit by moving the guide unit.

10. The apparatus for displaying the flying object of claim 1, wherein the blower is located within the flying space and circulates gas in an inside of the flying space by creating the air flow in the flying space.

11. The apparatus for displaying the flying object of claim 1, wherein the blower forms the flying space of the flying object together with the space forming unit and outputs the air flow to one of inside and outside of the flying space.

12. The apparatus for displaying the flying object of claim 1, wherein the space forming unit includes a partition dividing the flying space into a plurality of sub-spaces.

13. The apparatus for displaying the flying object of claim 10, wherein the space forming unit includes a partition having a hole through which the gas flows.

14. The apparatus for displaying the flying object of claim 11, wherein the space forming unit includes a partition having a hole through which the gas flows.

15. An apparatus for displaying a flying object comprising:

a space forming unit defining a flying space:

a blower for creating an air flow in the flying space;

a flying object for flying in response to the air flow in the flying space, wherein the flying object includes a fuselage having an axis of an airframe, defining a center of the flying object, a plurality of wings, and a plurality of reinforcing members joined to and increasing strength of the plurality of wings, and wherein the plurality of wings is joined symmetrically with respect to the axis of the airframe; and a connecting unit connected to the flying object, including a holding line restricting the fling object in the flying space.

* * * * *